US009775197B2

(12) United States Patent
Almolda Fandos et al.

(10) Patent No.: US 9,775,197 B2
(45) Date of Patent: Sep. 26, 2017

(54) PROTECTIVE DEVICE FOR A HEATING UNIT

(75) Inventors: Manuel Almolda Fandos, Saragossa (ES); Jose Maria Cozar Bartos, Saragossa (ES); Rual Escartin Sanchez, Huesca (ES); Jose-Ramon Garcia Jimenez, Saragossa (ES); Alfonso Lorente Perez, Saragossa (ES); Jose Maria Marin Herrero, Saragossa (ES); David Ortiz Sainz, Saragossa (ES); Carmelo Pina Gadea, Saragossa (ES); Demetrio Torrubia Marco, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 2308 days.

(21) Appl. No.: 11/879,621

(22) Filed: Jul. 16, 2007

(65) Prior Publication Data

US 2008/0017630 A1 Jan. 24, 2008

(30) Foreign Application Priority Data

Jul. 18, 2006 (ES) ..... 200601996

(51) Int. Cl.

| | |
|---|---|
| ***H05B 3/68*** | (2006.01) |
| ***H05B 3/74*** | (2006.01) |
| ***H05B 6/12*** | (2006.01) |
| ***F24C 15/10*** | (2006.01) |

(52) U.S. Cl.

CPC ..... *H05B 3/746* (2013.01); *F24C 15/101* (2013.01); *H05B 6/1263* (2013.01)

(58) Field of Classification Search

CPC .. F24B 1/18; F24B 1/181; F24B 1/195; F24B 1/198; F24C 1/14; F24C 1/10; F24C 7/04; F24C 7/10; F24D 5/00; F24D 5/02; F24D 5/04; F24D 5/10; F24H 3/00; F24H 3/02; F24H 3/10; H05B 3/746; H05B 6/1263

USPC ..... 219/391, 439, 481, 620–627; 126/19 R, 126/21, 273 R; 392/348, 349, 363, 370, 392/371, 376

See application file for complete search history.

(56) References Cited

U.S. PATENT DOCUMENTS

| | | | | |
|---|---|---|---|---|
| 1,426,433 | A | 8/1922 | Wiley | |
| 4,541,675 | A * | 9/1985 | Everett | 312/265.5 |
| 4,549,052 | A | 10/1985 | Simon | |
| 5,446,268 | A | 8/1995 | Chen | |
| 5,934,268 | A * | 8/1999 | Onocki | 126/512 |
| 2005/0133016 | A1* | 6/2005 | Neal et al. | 126/19 R |

FOREIGN PATENT DOCUMENTS

| | | | |
|---|---|---|---|
| DE | 19817197 | C2 | 7/2000 |
| GB | 2401173 | A | 11/2004 |
| JP | 3-122990 | A | 5/1991 |
| JP | 11-354263 | A | 12/1999 |

* cited by examiner

*Primary Examiner* — Brian Jennison
(74) *Attorney, Agent, or Firm* — Michael E. Tschupp; Andre Pallapies

(57) ABSTRACT

The invention is based on a protective device for a heating unit, in particular for a cooking apparatus (10), for protecting a heating unit against a hot air flow (44).
To achieve an effective cooling effect, it is proposed that the protective device for a heating unit comprises a shielding element (68), which is provided for this purpose to shield a space (46) provided for a cold cooling air flow (42) for cooling the heating unit (14) against the hot air flow (44).

46 Claims, 3 Drawing Sheets

PROTECTIVE DEVICE FOR A HEATING UNIT

Figure 1:
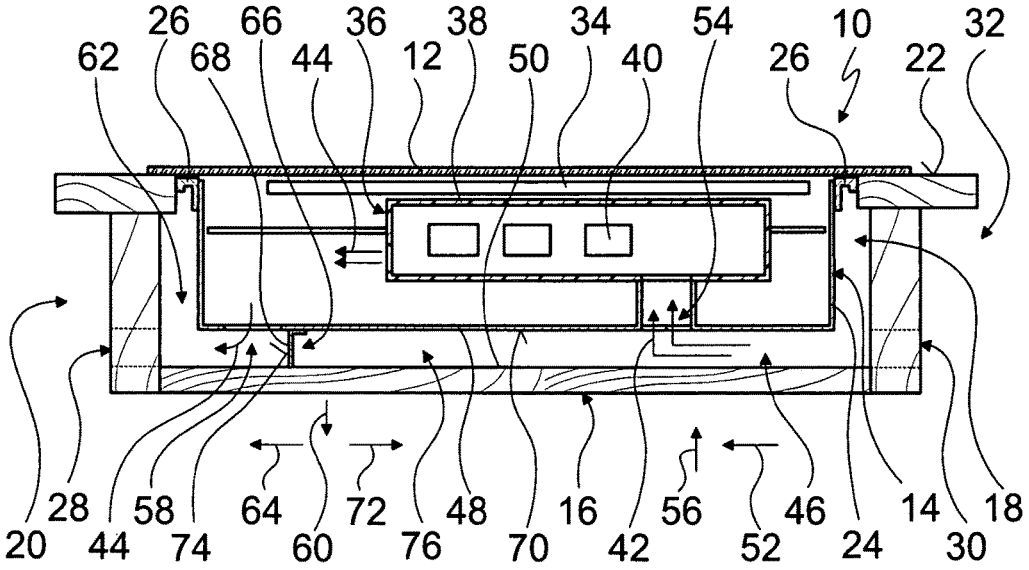

The invention is based on a protective device for a heating unit, in particular for a cooking apparatus.

A heating unit, particularly for an induction cooking apparatus, is known. This comprises a set of heating elements and electrical control components for controlling said heating elements. To prevent unintentional heating of the heating unit, in particular heating of the control components, the heating unit is provided with a protective device for a heating unit, which, during operation of the heating unit, cools the control components by means of a cooling air flow.

The object of the invention particularly consists of providing a generic protective device for a heating unit with improved cooling properties.

The object is achieved in accordance with embodiments of the invention described herein.

The invention is based on a protective device for a heating unit, in particular a cooking apparatus, for protecting a heating unit against a hot air flow.

It is proposed that the protective device for a heating unit comprises a shielding element which is provided for this purpose to shield a space provided for a cold cooling air flow to cool the heating unit from the hot air flow. A particularly effective cooling effect of the protective device for a heating unit can herewith be achieved. The hot air flow preferably corresponds to the cooling air flow heated by a flow in the heating unit and a cooling of internal components in the heating unit. During dissipation of the hot air flow out of the heating unit, the dissipation process of the hot air flow can comprise one or a number of dissipation directions. The shielding element advantageously allows a backflow of the hot air flow in a backflow direction to be prevented, which is essentially arranged opposite to the or one of the preferred dissipation directions. To this end, the shielding element is preferably arranged in a backflow region, which connects a space for dissipating the hot air flow with the space provided for the cold cooling air flow. In this way, the proportion of hot air which can be mixed with the cooling air flow can be reduced. The term "hot air flow" is to be understood in particular as an air flow which has a temperature which is greater than the temperature of the cold cooling air flow.

The shielding element preferably extends essentially at right angles to the backflow direction and expediently comprises a shielding surface, which covers at least 80%, advantageously 85% and particularly preferably at least 90% of the cross-sectional surface of the backflow area at right angles to the backflow direction, as a result of which the unwanted mixing of the cold and hot air can be reduced in a particularly effective manner. This mixing can be prevented in a particularly advantageous manner if the shielding element is provided to seal off the space.

The heating unit preferably comprises at least one heating element, at least one electrical control unit for controlling the heating element and a housing for accommodating the heating element and/or the control unit. The cold cooling air flow is used for instance to cool the control unit, in particular to cool electrical components in the control unit. The protective device for a heating unit can be particularly advantageously used in a cooking apparatus. The protective device for a heating unit provided with the shielding element enables high performance working processes of the cooking apparatus, with a highly protected and a long service life of the cooking apparatus being able to be achieved. The protective device for a heating unit according to the invention is particularly suited to protecting a heating unit, which is used with an induction cooking apparatus. The shielding element enables an effective protection of electronic, heat-sensitive control components to be achieved, in particular switching means embodied as semiconductor elements, in order to control induction elements. The heating unit itself can be embodied as a cooking apparatus and/or induction cooking apparatus, such as for instance an induction stove top.

In an advantageous embodiment of the invention, it is proposed that the shielding element, in a working position relative to the heating unit, delimits a cold space which is accessible to cold air, said cold space essentially extending across the area of the heating unit. The cold space essentially extends across the area of the heating unit, if the cold space extends in particular over at least 50%, advantageously at least 60% and particularly preferably at least 70% across a housing exterior surface of the heating unit. The cooling effect can herewith be further increased by arranging the heating unit in an environment provided with cool air. Particularly advantageously, the cold space preferably extends across an area of the heating unit, in which electrical components generating heat, in particular control components of a heating element, are arranged. If the cold space is immediately adjacent to the housing exterior surface of the heating unit, an advantageous direct cooling of the heating unit can also be achieved across the housing exterior surface thereof.

In a preferred embodiment of the invention, it is proposed that the shielding element, in an assembled state, is directly coupled with the heating unit, as a result of which a particularly effective shielding can be achieved in the direct surroundings of the heating unit.

In this context, it is proposed that the shielding element, in an assembled state, be secured onto an exterior side of a housing of the heating unit, as a result of which a space bordering the housing of the heating unit can be shielded in a particularly simple manner.

A particularly effective dissipation of the hot air flow can be achieved and components, installation space, costs and assembly outlay can be saved if the shielding element comprises a guide region for guiding the hot air flow.

In a preferred embodiment of the invention, it is proposed that the shielding element is arranged in the area of an air passage opening of the heating unit. This herewith easily enables an advantageous guiding of an air flow flowing through the air passage opening in a desired direction to be achieved. The shielding element is preferably arranged in the area of an air passage opening for dissipating the hot air flow out of the heating unit. The shielding element is arranged "in the area" of the air passage opening if it is, in particular, arranged within an area around the air passage opening, which extends at a distance from the edge of the air passage opening, which amounts at the most to 20%, advantageously at the most to 10% and preferably at the most to 5% of an extension of the air passage opening. An extension can be understood to mean a main extension or a diameter for instance, as a function of the design of the air passage opening. A particularly good air guide can be achieved particularly advantageously if the shielding element is arranged on the edge of the air passage opening.

In a further preferred embodiment of the invention, it is proposed that the shielding element in a working position relative to a furniture unit for coupling with the heating unit shields the space in conjunction with the furniture unit, as a result of which a particularly compact design of the protective device for a heating unit can be achieved. A "working position" of the shielding element can be understood in particular to mean a position of the shielding element relative to the furniture unit, if the heating unit provided with the shielding element is mounted on the furniture unit.

A particularly compact design of the protective device for a heating unit can be achieved if, when the shielding element is in a coupled state with the furniture unit, the shielding element is directly coupled to the furniture unit and the heating unit.

In a preferred embodiment of the invention, it is proposed that the shielding element be formed from a piece of sheet metal, as a result of which a simple production and a cost-effective design of the protective device for a heating unit can be achieved.

A compact embodiment of the protective device for a heating unit can also be achieved, if the protective device for a heating unit comprises a securing unit for securing the shielding element to a support element, which is designed in one piece with the shielding element. In this way, production costs can be reduced, if the shielding element and the securing unit are formed from a common piece of sheet metal.

In an advantageous embodiment of the invention, the protective device for a heating unit includes a securing unit for securing the shielding element to a support element, which comprises an attachment leg, as a result of which a particularly high stability of the shielding element in a fixed state can be achieved.

An advantageous flexibility in the use of the protective device for a heating unit can also be achieved if the protective device for a heating unit comprises an attachment module, which is provided for optionally fastening the shielding element in at least two securing positions to the heating unit. In this way, the attachment module preferably comprises at least two attachment regions of the heating unit, which are provided in each instance to attach the shielding element. Alternatively or in addition, the attachment module advantageously comprises at least one securing unit which allows the shielding element to be secured in at least two different alignments of the shielding element relative to the heating unit.

In this context, it is proposed that at least one securing position is embodied as a transport position to secure the shielding element to the heating unit during transportation of the heating unit. Transportation effort and costs can herewith be reduced and a loss of the shielding element during transportation of the heating unit can advantageously be avoided.

Space can be saved particularly during the transportation of the heating unit if the shielding element in the transport position surrounds the heating unit. This can be achieved in a particularly simple manner if an attachment leg is formed onto the shielding element.

Figure 2:
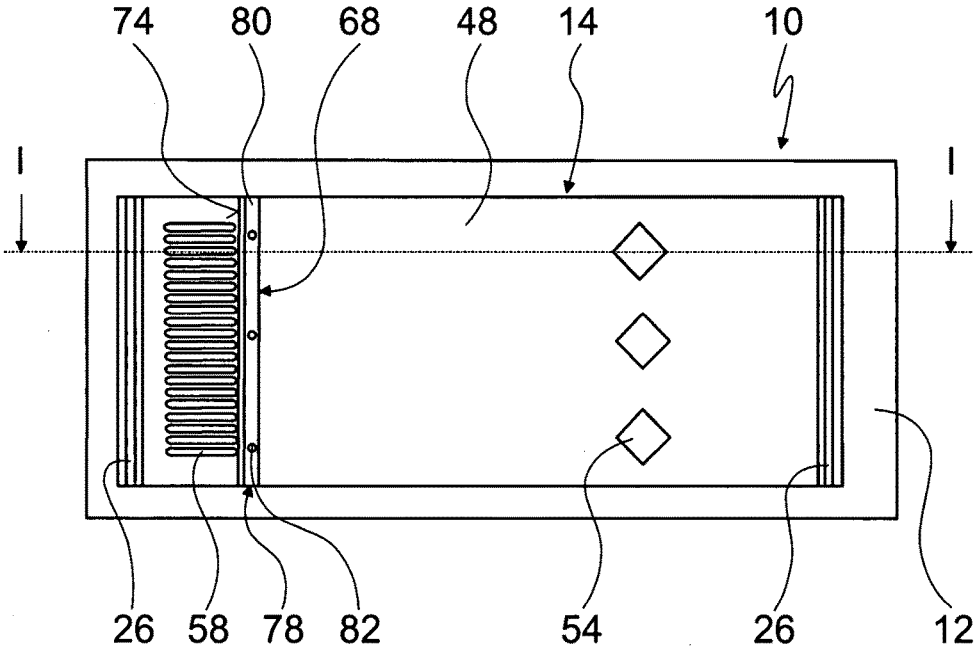
Figure 3:
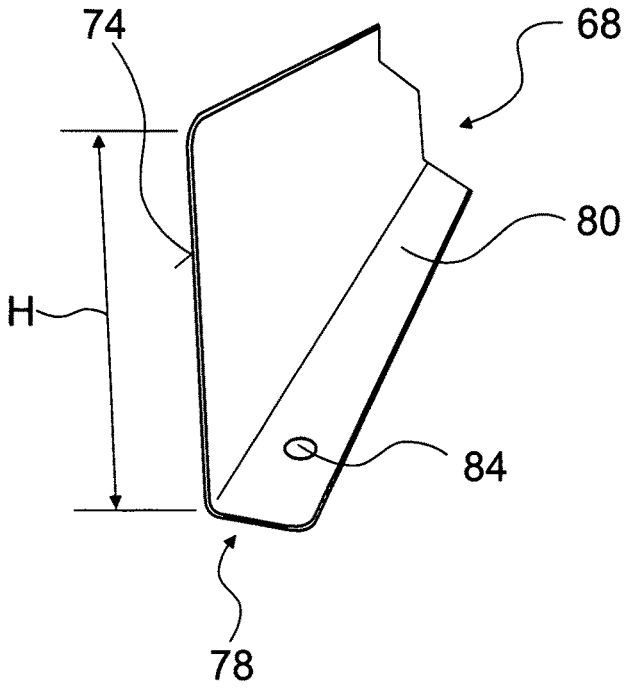
Figure 4:
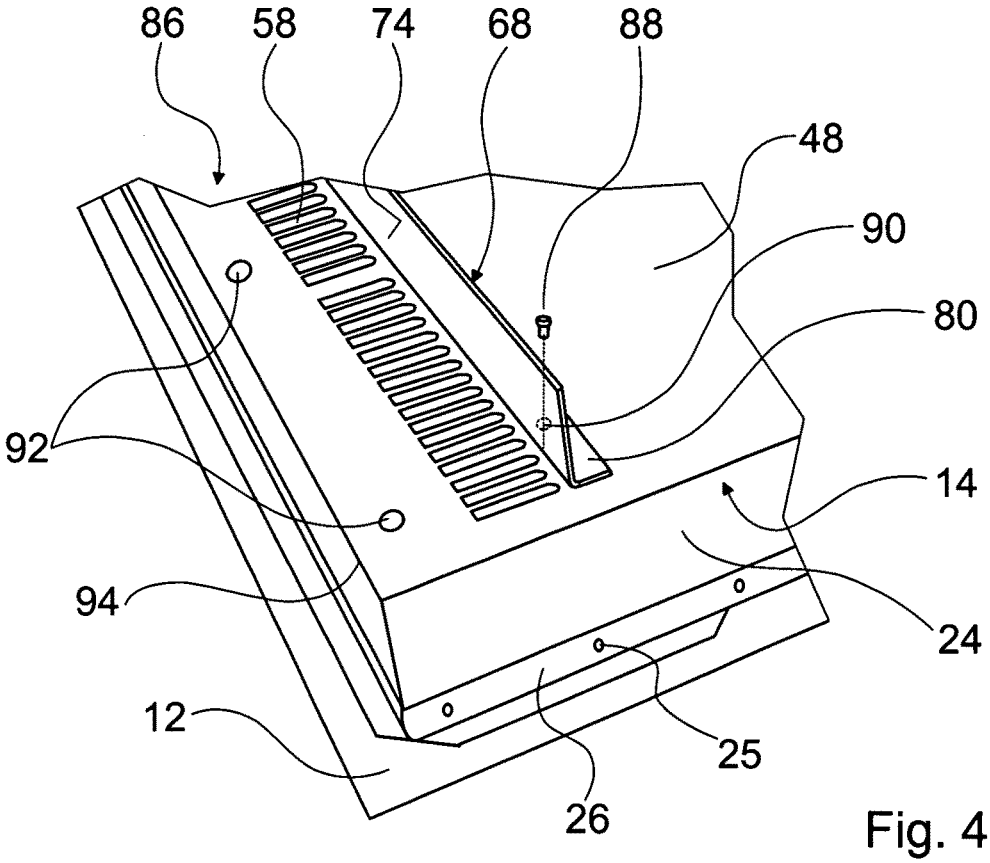
Figure 5:
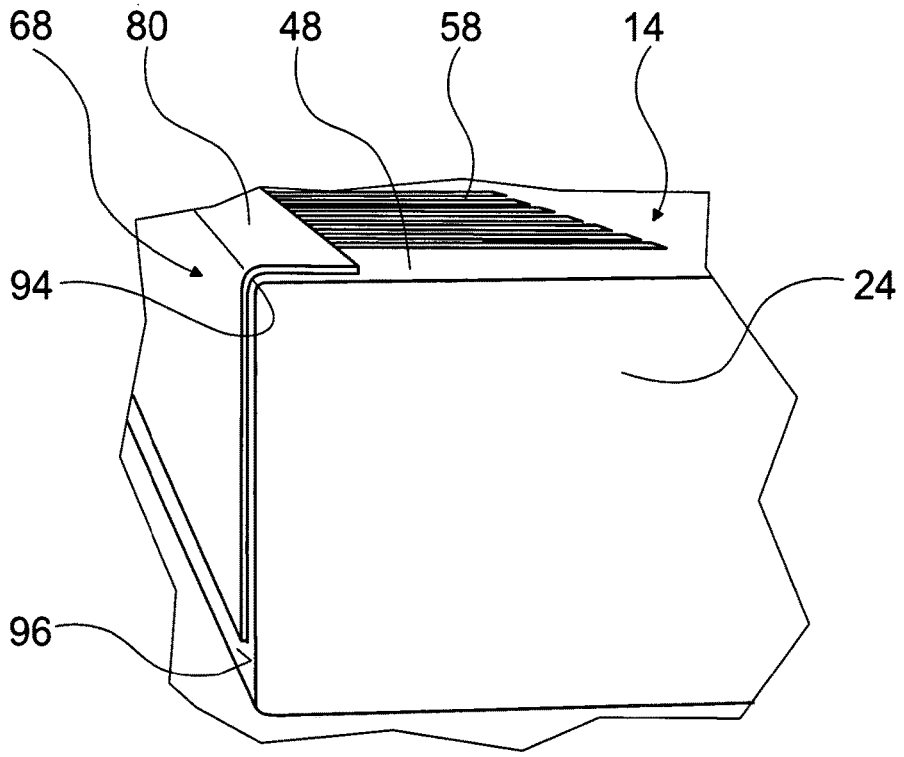

Further advantages result from the description of the drawings as follows. Exemplary embodiments of the invention are shown in the drawing. The drawing, the description and the claims contain numerous features in combination. The person skilled in the art will also expediently examine the features individually and combine them to form meaningful further combinations, in which;

FIG. 1 shows a sectional view of a stove top arranged in a furniture unit with a shielding element for preventing a backflow of a hot air flow, FIG. 2 shows a view from below of the stove top removed from the furniture unit from FIG. 1, FIG. 3 shows a perspective view of the shielding element from FIG. 1, FIG. 4 shows the stove top with the shielding element in its working position and FIG. 5 shows the stove top with the shielding element in its transport position.

FIG. 1 show a cooking apparatus 10 embodied as an induction stove top. This includes a hot plate 12 embodied as a ceramic plate for placing cookware and a heating unit 14. A furniture unit 16 embodied as a wooden housing can also be seen, which forms a receiving region 18, in which the heating unit 14 of the cooking apparatus 10 is accommodated. The figure represents a sectional view of the arrangement of the cooking apparatus 10 and of the furniture unit 16 transversely to its front panel 20, which faces a user during operation of the cooking apparatus 10. The furniture unit 16 can be mounted on a cabinet (not shown), which forms a counter top for instance. Alternatively, the furniture unit 16 can be embodied in one piece with this cabinet. The furniture unit 16 comprises a bearing area 22, on which the hot plate 12 of the cooking apparatus 10 is positioned. The heating unit 14 comprises housing 24 embodied as a metal housing. The attachment legs 26, which are fastened to the housing 24 by means of screw joints 25, secure the housing 24 to the hot plate 12. The furniture unit 16 also has air passage openings 28, 30 (shown by way of dashed line in the Figures), namely a first air passage opening 28 on the front panel 20 and a further air passage opening 30 on a rear panel 32 opposite to the front panel 20. The furniture unit 16 can comprise additional air passage openings, which are arranged in each instance on a side of the furniture unit 16 at right angles to the front panel 20.

A heating element 34 embodied as an induction coil, and schematically shown in the Figure is arranged within the housing 24 to heat an item of cookware placed on the hot plate 12. A control unit 36 is also mounted in the housing 24. This comprises a plastic housing 38, in which control element 40 for controlling an operation of the heating element 34 are accommodated. These control elements 40 form an electronic switching system, which supplies the heating element 34 with an alternating current in a heating process by means of switching processes of semiconductor elements. The heating element 34 supplied with alternating current transmits a magnetic alternating field with a heating frequency, which generates heat in the cookware by means of induction effects.

During a heating process, particularly by means of switching processes of the electronic switching system, heat is generated within the heating unit 14. The control unit 36 is ventilated during operation of the heating unit 14 in order to prevent an increase in temperature of the heating unit 14 which would be damaging to the control elements 40. An air flow which flows through the heating unit 14 and in particular through the control unit 36 is generated by means of a ventilator (not shown in more detail). The air flow is composed of a cold cooling air flow 42, which is fed from the air passage opening 30 of the furniture unit 16 into the heating unit 14, and a hot air flow 44, which corresponds to the cooling air flow 42 heated in the control unit 36 and is dissipated out of the heating unit 14 and through the air through-opening 28 to the front panel of the furniture unit 16.

After flowing through the air passage opening 30 into the receiving region 18, the cold cooling air flow 42 passes into a space 46 provided for its flows, said space being formed by a base plate 48 of the housing 24 and a base region 50 of the furniture unit 16 running parallel to the base plate 48 and below the base plate 48. The base plate 48 corresponds to one side of the housing 24, which, when the cooking apparatus 10 is in an assembled state, is arranged below the control unit 36, whereas the hot plate 12 is arranged above the control unit 36. Within the space 46, the cold cooling air flow 42 is fed in a first flow direction 52 which is aligned parallel to the base plate 48 and in the direction of the front panel 20. The cold cooling air flow 42 is then guided into the control unit 36 through a set of air passage openings 54, which are formed from the base plate 48 of the housing 24 (see also FIG. 2), in a second flow direction 56, which is aligned at right angles to the first flow direction 52 in the direction of the hot plate 12. The hot air flow 44 flowing out of the control unit 36 is guided through a set of further air passage openings 58 of the base plate 48, which are embodied as slits (FIG. 2) from the heating unit 14 in a first dissipation direction 60 aligned at right angles to the base plate 48 of the housing 24 in the direction of the base region 50. After the hot air flow 44 has flowed out of the heating unit 14, said hot air flow is guided within an dissipation region 62 in a second dissipation direction 64, which is aligned at right angles to the first dissipation direction 60 and parallel to the base region 50 in the direction of the air passage opening 28 of the furniture unit 16, into the air through opening 28 of the furniture unit 16. The set of air passage openings 58 is arranged in an end region of the heating unit 14 arranged in the region of the front panel 20 of the furniture unit 16, as a result of which a particularly short path of the hot air flow 44 within the receiving region 18 is achieved. The air passage opening 28 is also arranged in the region of the base region 50 of the furniture unit 16. By dissipating the hot air flow 44 to this location, a good sealing of the receiving region 18 in its upper region can be achieved in contrast to a dissipation in the region of the hot plate 12, as a result of which an advantageous protection of the heating element 34 and the control unit 36 against a penetration of dirt or liquid is achieved.

To protect the heating unit 14 from a backflow of the hot air flow 44, the cooking apparatus 10 is also provided with a protective device for a heating unit 66. The protective device for a heating unit 66 comprises a shielding element 68 which is embodied as an L-shaped piece of sheet metal. This is secured to the exterior 70 of the housing 24 formed by the base plate 48 on the edge of the air passage openings 58 of the heating unit 14. The shielding element 68 is arranged in a backflow region, which is formed by the base plate 48 and the base region 50 of the furniture unit 16 and connects the dissipation region 62 with the space 46 provided for the cold cooling air flow 42. The shielding element 68 allows a backflow of the hot air flow 44 in backflow direction 72 opposite to the second dissipation direction 64 to be prevented. To this end, the shielding element 68 forms a shielding surface 74 facing the air passage openings 58, said shielding surface 74 running transverse to the backflow direction 72 across the width of the base plate 48 (See FIG. 2). The shielding surface 74 also extends at right angles to the base plate 48 until adjoining to the base region 50 of the furniture unit 16. Subsequently, the space 46 provided for the cold cooling air flow 42 is shielded and/or sealed from the hot air flow 44 by means of the shielding element 68 in its illustrated working position in conjunction with the base region 50. The arrangement of the shielding element 68 on the edge of the air passage openings 58 allows the shielding surface 74 to additionally form a guide region extending in the first dissipation direction 60 for guiding the hot air flow 44. The shielding element 68 also delimits a cold space 76 in conjunction with the base plate 48 and the base region 50. This cold space 76, of which the space 46 provided for the cold cooling air flow 42 is a part, is accessible for cold air. The arrangement of the shielding element 68 in the end region of the base plate 48 in the region of the front panel 22 allows this cold space 76 to extend across a significant region of the heating unit 14. This herewith enables an additional cooling of the heating unit 14 across its exterior 70 to be achieved. The cold space 76 particularly advantageously extends across the control unit 36, which contributes to heating the heating unit 14 to a considerable degree.

FIG. 2 shows a view from below of the cooking apparatus 10 separated from the receiving region 18. The air passage openings 58 embodied as slits can be seen in particular, said air passage openings extending in each instance in the longitudinal direction of the housing 24. The shielding element 68 is fastened to the base plate 48 by means of a securing unit 78. This comprises an attachment leg 80, which is embodied in one piece with the shielding element 68 and rests on the base plate 48 in an assembled state. During the manufacture of the shielding element 68, the attachment leg 80 is formed with the shielding surface 74 from a common piece of sheet metal. The attachment leg 80 is fastened to the base plate 48 by means of screw joints 82.

FIG. 3 shows the shielding element 68 in a perspective view. As already described above, the shielding element 68 is embodied as an L-shaped piece of sheet metal. This piece of sheet metal forms the shielding surface 74, which seals the backflow region between the dissipation region 62 and the space 46 from a backflow of the hot air flow 44 when the heating unit 14 is in an assembled state. In this example, the shielding surface 74 has a height H of approximately 50 mm, which corresponds to the distance between the base region 50 of the furniture unit 16 and the base plate 48 of the heating unit 14. The attachment leg 80 of the securing unit 78 is also formed from the piece of sheet metal, said attachment leg 80 resting against the base plate 48 in the working position of the shielding element 68 as shown in FIG. 1 and being fastened hereto by means of screw joints 82. To this end, openings 84 of the securing unit 78 for passing through a screw are cut out from the attachment leg 80.

FIG. 4 shows the heating unit 14 and the shielding element 68 of the protective device for a heating unit 66, which, in its working position, is fastened to the edge of the air passage openings 58. The attachment legs 26 can also be seen, by means of which the housing 24 is fastened to the hot plate 12. The protective device for a heating unit 66 also has an attachment module 86, by means of which the shielding element 68 can be fastened to the heating unit 14 in two different positions relative to the heating unit 14. To fasten the shielding element 68 in its working position as shown, the attachment module 86 comprises screws 88, screw recesses 90, which are cut out of the base plate 48, the attachment let 80 of the shielding element 68 and its openings 84. To fasten the shielding element 68 in a transport position as shown in FIG. 5, the attachment module 86 also has screw recesses 92, which are arranged in the region of an edge 94 of the housing 14.

The shielding element 68 is illustrated in FIG. 5 in its transport position. In this transport position, the heating unit 14 is surrounded by the shielding element 68. In this way, the shielding element 68 embodied as an L-shaped piece of sheet metal rests completely on the housing 24, as a result of which space can advantageously be saved during transportation of the heating unit 14. The shielding element 68, namely the attachment leg 80, rest here on the base place 48, surrounds the edge 94 and rests on a side surface 96 of the housing 24 which is aligned at right angles to the base plate 48 and borders the base plate 48. After transport of the heating unit 14 and during the assembly of the cooking apparatus 10, the shielding element 68 can be unscrewed from its transport position and screwed into its working position as shown in FIG. 4.

REFERENCE CHARACTERS

| | |
|---|---|
| 10 | Cooking apparatus |
| 12 | Hot plate |
| 14 | Heating unit |
| 16 | Furniture unit |
| 18 | Receiving region |
| 20 | Front panel |
| 22 | Bearing area |
| 24 | Housing |
| 25 | Screw joint |
| 26 | Attachment leg |
| 28 | Air passage opening |
| 30 | Air passage opening |
| 32 | Rear side |
| 34 | Heating element |
| 36 | Control unit |
| 38 | Plastic housing |
| 40 | Control element |
| 42 | Cooling air flow |
| 44 | Hot air flow |
| 46 | Space |
| 48 | Base plate |
| 50 | Base region |
| 52 | Flow direction |
| 54 | Air passage opening |
| 56 | Flow direction |
| 58 | Air passage opening |
| 60 | Dissipation direction |
| 62 | Dissipation area |
| 64 | Dissipation direction |
| 66 | Protective device for a heating unit |
| 68 | Shielding element |
| 70 | Exterior |
| 72 | Backflow direction |
| 74 | Shielding surface |
| 76 | Cold space |
| 78 | Securing unit |
| 80 | Attachment leg |
| 82 | Screw joint |
| 84 | Opening |
| 86 | Attachment module |
| 88 | Screw |
| 90 | Screw recess |
| 92 | Screw recess |
| 94 | Edge |
| 96 | Side surface |

The invention claimed is:

1. A cooking apparatus comprising:

a furniture unit defining, at least in part, a receiving region, and the furniture unit having a base region, a first air passage opening, and a second air passage opening;

a heating unit positioned in the receiving region, the heating unit having a housing, and the housing comprising a base plate, a cool air inlet, and a hot air outlet;

a space in the receiving region, the space defined between the base plate and the base region;

a cool air flow path to direct a flow of cool air from the first air passage opening, through the space, and into the housing through the cool air inlet;

a hot air flow path to direct a flow of hot air from the housing through the hot air outlet and out the second air passage opening; and a shielding device having an assembled position, wherein in the assembled position the shielding device is positioned in the space between to the hot air outlet and the cool air inlet to define a cold space between the base plate and the base region such that cool air from the first air passage opening is contained in the cold space.

2. The cooking apparatus as claimed in claim 1, wherein the shielding device is positioned in the space such that the cold space extends across at least 50% of the surface area of the housing.

3. The cooking apparatus as claimed in claim 1, wherein the shielding device extends perpendicularly from the base plate.

4. The cooking apparatus as claimed in claim 1, wherein the heating unit comprises a heating element and a control unit to control the heating element.

5. The cooking apparatus as claimed in claim 4, wherein the cold space is separated from the heating element and the control unit by the housing.

6. The cooking apparatus as claimed in claim 4, wherein the heating unit comprises a hot plate positioned above the heating element.

7. The cooking apparatus as claimed in claim 1, wherein the heating unit comprises an induction heating unit.

8. The cooking apparatus as claimed in claim 1, wherein the housing is joined to the furniture unit with attachment legs.

9. The cooking apparatus as claimed in claim 1, wherein the shielding device comprises a shielding element and an attachment leg perpendicular to the shielding element, wherein the shielding device has a transport position, and wherein the shielding element is positioned against a side surface of the housing and the attachment leg is positioned against the base plate when the shielding device is in the transport position.

10. A cooking apparatus comprising:

a furniture unit defining, at least in part, a receiving region, and the furniture unit having a base region, a first air passage opening, and a second air passage opening;

a heating unit positioned in the receiving region, the heating unit having a housing, and the housing comprising a base plate, a cool air inlet, and a hot air outlet;

a space in the receiving region, the space defined between the base plate and the base region;

a cool air flow path to direct a flow of cool air from the first air passage opening, through the space, and into the housing through the cool air inlet;

a hot air flow path to direct a flow of hot air from the housing through the hot air outlet and out the second air passage opening; and a shielding device having an assembled position, wherein in the assembled position the shielding device is positioned in the space and between the hot air outlet and the cool air inlet to prevent the flow of hot air from the hot air outlet from flowing into the housing through the cool air inlet.

11. The cooking apparatus as claimed in claim 10, wherein the shielding device is coupled to the base plate.

12. The cooking apparatus as claimed in claim 11, wherein the shielding device comprises an attachment leg, and the attachment leg is secured to the base plate.

13. The cooking apparatus as claimed in claim 10, wherein the shielding device defines, at least in part, a guide region to direct the flow of hot air from the hot air outlet.

14. The cooking apparatus as claimed in claim 10, wherein the shielding device comprises sheet metal.

15. The cooking apparatus as claimed in claim 10, wherein the shielding device extends perpendicularly from the base plate.

16. The cooking apparatus as claimed in claim 15, wherein the shielding device is dimensioned to cover at least 80% of the cross-sectional area of the space.

17. The cooking apparatus as claimed in claim 10, wherein a dissipation region is defined in the receiving region between the housing and the furniture unit, the dissipation region positioned downstream of the hot air outlet and upstream of the second air passage opening.

18. The cooking apparatus as claimed in claim 10, wherein the heating unit comprises a heating element and a control unit to control the heating element.

19. The cooking apparatus as claimed in claim 18, wherein the cool air flow path passes through the housing such that the heating element and the control unit dissipate heat to the flow of cool air.

20. The cooking apparatus as claimed in claim 18, wherein the heating unit comprises a hot plate positioned above the heating element.

21. The cooking apparatus as claimed in claim 10, wherein the heating unit comprises an induction heating unit.

22. The cooking apparatus as claimed in claim 10, wherein the housing is joined to the furniture unit with attachment legs.

23. The cooking apparatus as claimed in claim 10, wherein the shielding device comprises a shielding element and an attachment leg perpendicular to the shielding element, wherein the shielding device has a transport position, and wherein the shielding element is positioned against a side surface of the housing and the attachment leg is positioned against the base plate when the shielding device is in the transport position.

24. A cooking apparatus comprising:

a heating unit that has a cooling air inlet via which cooling air enters interiorly of the heating unit and a heated air exit outlet via which hot air that had previously entered the heating unit via the cooling air inlet and had become heated exits the heating unit;

a shielding device having a shielding element structured to be attached to the heating unit in a shielding position and a non-shielding transport position and the shielding device having an attachment leg structured to attach the shielding element to the heating unit in the shielding position and the non-shielding transport position, wherein the shielding element is structured to substantially seal a space along which a cooling air flows to the cooling air inlet from a space along which air that has exited the heated air exit outlet flows when the shielding element is in the shielding position, wherein the shielding element is structured to be attached to the heating unit such that a surface of the shielding element and a surface of the attachment leg are substantially flush with the heating unit when the shielding element is in the non-shielding transport position.

25. The cooking apparatus as claimed in claim 24, wherein the shielding element is structured to delimit a cold space which is accessible to cold air, said cold space essentially extending across a region of the heating unit when the shielding element is in the shielding position.

26. The cooking apparatus as claimed in claim 24, wherein the shielding element is directly coupled to the heating unit in the shielding position and the non-shielding transport position.

27. The cooking apparatus as claimed in claim 24, wherein the shielding element is secured to a housing of the heating unit via the attachment leg in the shielding position and the non-shielding transport position.

28. The cooking apparatus as claimed in claim 24, wherein the shielding element defines, at least in part, a guide region to guide the hot air from the heated air exit outlet when the shielding element is in the shielding position.

29. The cooking apparatus as claimed in claim 24, wherein the shielding element is arranged in a region of an air passage opening of the heating unit when the shielding element is in the shielding position.

30. The cooking apparatus as claimed in claim 24, wherein the shielding element is configured to shield the space in conjunction with a furniture unit when the shielding element is in the shielding position.

31. The cooking apparatus as claimed in claim 24, wherein the shielding element comprises sheet metal.

32. The cooking apparatus as claimed in claim 24, wherein the attachment leg and the shielding element comprise one piece.

33. The cooking apparatus as claimed in claim 32, further comprising a securing unit to secure the shielding element via the attachment leg.

34. A heating unit operable to be positioned in a receiving region of a furniture unit, the heating unit comprising:

a housing having a base plate, a hot air outlet, a cooling air inlet via which cooling air enters, and a heated air exit outlet via which hot air that had become heated exits the heating unit; and a protective device comprising:

a shielding element configured to be attached to the housing in a shielding position and a non-shielding transport position; and an attachment leg structured to attach the shielding element to the housing in the shielding position and the non-shielding transport position, wherein, when the shielding element is in the shielding position, the shielding element is structured and dimensioned to substantially seal a space along which a cooling air flows to the cooling air inlet from a space along which air that has exited the heated air exit outlet flows, wherein, when the shielding element is in the non-shielding transport position, the shielding element is structured to be attached to the housing such that a surface of the shielding element and a surface of the attachment leg are substantially flush with the housing.

35. The heating unit as claimed in claim 34, wherein the shielding element is structured to delimit a cold space which is accessible to cold air, said cold space essentially extending across a region when the shielding element is in the shielding position.

36. The heating unit as claimed in claim 34, wherein the shielding element is directly coupled to the housing in the shielding position and the non-shielding transport position.

37. The heating unit as claimed in claim 34, wherein the shielding element is secured to the housing via the attachment leg in the shielding position and the non-shielding transport position.

38. The heating unit as claimed in claim 34, wherein the shielding element defines, at least in part, a guide region to guide the hot air from the heated air exit outlet when the shielding element is in the shielding position.

39. The heating unit as claimed in claim 34, wherein the shielding element is arranged in a region of an air passage opening when the shielding element is in the shielding position.

40. The heating unit as claimed in claim 34, wherein the shielding element is configured to shield the space in conjunction with a furniture unit when the shielding element is in the shielding position.

41. The heating unit as claimed in claim 34, wherein the shielding element comprises sheet metal.

42. The heating unit as claimed in claim 34, wherein the attachment leg and the shielding element comprise one piece.

43. The heating unit as claimed in claim 42, further comprising a securing unit to secure the shielding element via the attachment leg.

44. The heating unit as claimed in claim 34, wherein shielding element is structured to extend from housing when the protective device is in the shielding position, and wherein the shielding element is substantially flush with the housing when the protective device is in the non-shielding transport position.

45. The heating unit as claimed in claim 34, wherein the shielding element comprises a hot air surface that is adapted to contact the hot air and a cooling air side that is adapted to contact the cooling air, when the protective device is in the shielding position.

46. The heating unit as claimed in claim 45, wherein the cooling air side is adapted to be substantially flush with the housing when protective device is in the non-shielding transport position.

* * * * *